United States Patent [19]

Lih-Liaw

[11] 4,246,873

[45] Jan. 27, 1981

[54] PRESSURE ADDIBLE ENGINE

[76] Inventor: Jiing Lih-Liaw, No. 18 La. 136 Yung Ho. St., Taichung City, Taiwan

[21] Appl. No.: 950,434

[22] Filed: Oct. 11, 1978

[51] Int. Cl.[3] ..... F22D 9/00

[52] U.S. Cl. ..... 123/48 AA; 123/48 A; 123/78 AA; 123/78 A

[58] Field of Search ..... 123/27 R, 32 C, 48 R, 123/48 A, 48 AA, 78 R, 78 A, 78 AA, 193 H, 193 CH, 78 D, 26, 30 R, 32 E, 30 E, 32 J, 33 B, 33 C, 33 E

[56] References Cited

U.S. PATENT DOCUMENTS

| | | | |
|---|---|---|---|
| 922,613 | 5/1909 | McClintock | 123/78 A |
| 1,054,080 | 2/1913 | Bachmann | 123/26 |
| 2,991,767 | 7/1961 | Candelise | 123/26 |
| 3,182,645 | 5/1965 | Wilson | 123/26 |
| 3,650,261 | 3/1972 | Hutsell | 123/26 |
| 3,964,452 | 6/1976 | Nakamura | 123/78 AA |
| 4,103,648 | 8/1978 | Jarry | 123/32 E |

FOREIGN PATENT DOCUMENTS

| | | | |
|---|---|---|---|
| 487932 | 12/1953 | Italy | 123/78 A |

*Primary Examiner*—Ronald H. Lazarus

*Attorney, Agent, or Firm*—Cushman, Darby & Cushman

[57] ABSTRACT

An engine capable of storing high pressure gases and discharging them to increase the pressure of compressed fuel-mixture. A gas storage chamber is provided adjacent to the combustion chamber. The chamber opens to release high pressure gases just prior to ignition and closes just after ignition to store ignited gases until just prior to the next ignition. The working efficiency of an engine goes up as its compression ratio increases.

1 Claim, 1 Drawing Figure

PRESSURE ADDIBLE ENGINE

BACKGROUND

The degree of combustion of an engine depends on the compression ratio of the fuel mixture in the engine chamber. A highly compressed fuel mixture makes relatively perfect combustion and provides higher efficiency. But in practice, when the compression ratio exceeds 10 for a gasoline engine or 22 for a diesel engine, the mixture will burn and thereby create power to resist the inward travel of the engine piston. Thus a higher compression ratio of fuel mixture in an engine is difficult to acquire.

Moreover, the resistance to piston travel before its returning point (the maximum inward position of the piston) not only causes power losses but also shocks the engine itself.

A low fuel/air mixture might permit a higher compression ratio without burning itself, but it is another problem whether the engine structure can withstand the pressure.

SUMMARY OF THE INVENTION

A purpose of the present invention is to increase the pressure of the compressed fuel mixture right before the piston reaches the maximum inward position by supplying high pressure gases from a pressure storing chamber. This chamber is located adjacent to the burning chamber of the engine and has a gas channel connecting to the burning chamber. One valve in the gas channel performs the discharge of the stored pressure gases to the burning chamber to add the pressure of compressed fuel mixture while the valve is opened synchronously with the main piston approaching its maximum inward position, and performs the storage of the burned high pressure gases from the burning chamber while the valve is closed again before the engine goes into the exhaust stage.

The valve which operates to control the storage and discharge of the high pressure gases is closed and opened at the appropriate times by the action of a cam. When the engine is in its power stroke, the burned gases flow through the valve into the storing chamber until the peak pressure is reached and stored in the chamber by a prompt closing of the valve.

Since the burned high pressure gases are at a much higher pressure than that of the compressed fuel mixture, therefore, when the engine again is in compression and at the maximum compression stage, by opening the valve and enabling the stored high pressure gases to flow into the burning chamber the compressed fuel-mixture pressure is increased.

The present invention is not designed for lifting the power pressure of the engine directly from the added pressure but indirectly from a relatively perfect combustion of the compressed fuel-mixture. Theoretically, the added pressure shall return to the storing chamber and the pressure reduced after one cycle. But a relative perfect combustion of the gas mixture will produce additional power, more than compensatory for the pressure loses to the storage chamber. Thus, in practice, the present invention provides a higher working efficiency than a conventional engine provides.

DETAILED DESCRIPTION OF THE INVENTION

Figure 1:
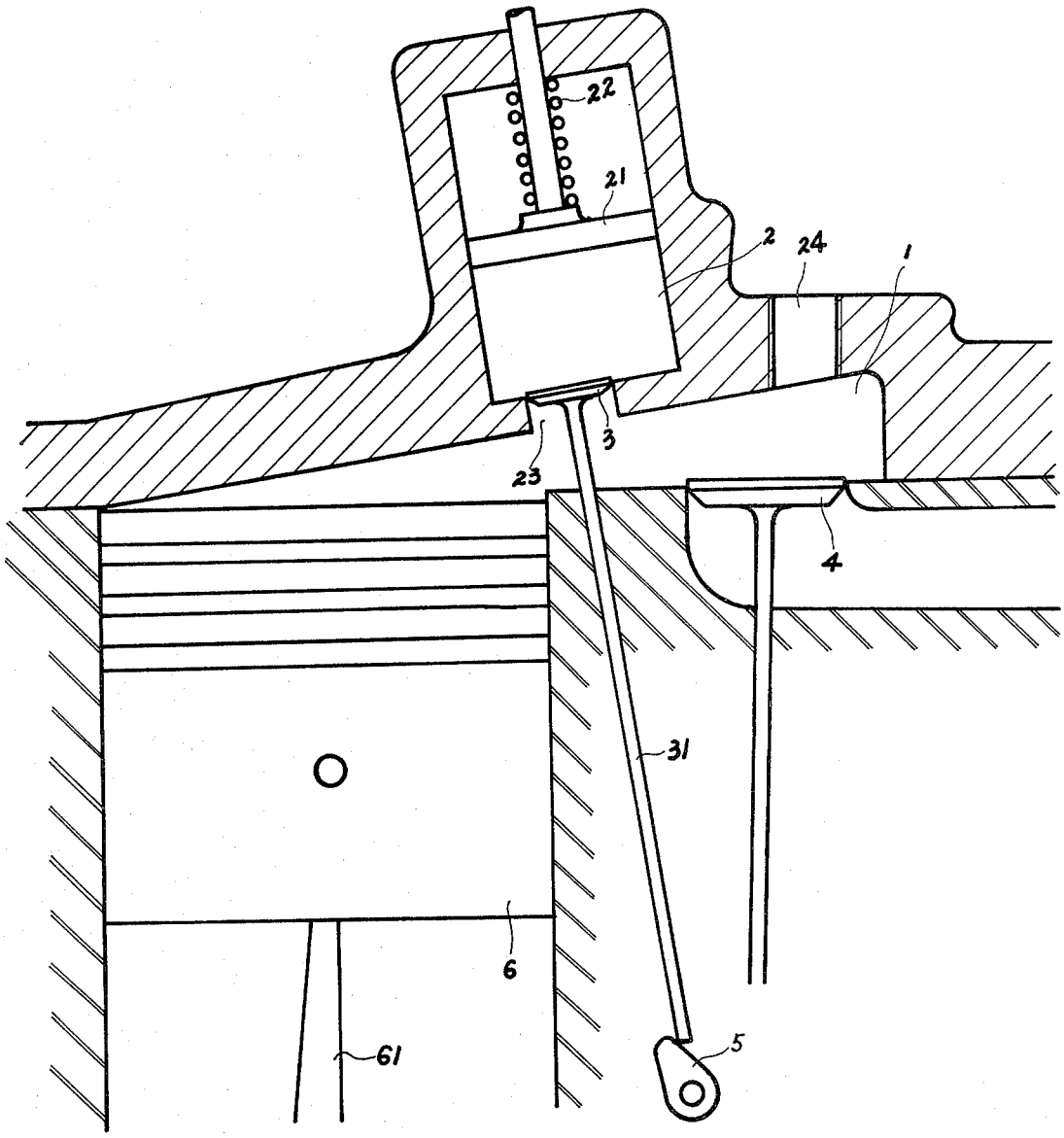

FIG. 1 showing the present invention configuration in cut away view, wherein, one pressure storing chamber 2 is connected to the burning chamber 1 by a gases channel 23, one valve 3 in channel 23 performs closing or opening of the channel 23, valve rod 31 extends outside to a cam 5 which opens and closes the valve 3 at appropriate times. Inside the storing chamber 2, one piston 21 is mounted against one spring 22 so that some of the exhaust gas energy may be stored in the spring.

Spacing port 24 serves for fitting a spark plug when the invention is used as a spark ignition engine, and serves for fitting a fuel injection nozzel when the invention is used as a compression ignition engine. Intake or exhaust valve 4 operates in a convention manner as the gas intake or exhaust of the engine. Main piston 6 and piston rod 61 inside the cylinder operate in a conventional manner for fuel-mixture compression and working.

Valve 3 and cam 5 are be designed so that when piston 6 is duly travelling at right about its maximum inward position and before the fuel-mixture ignition, the cam 5 opens the valve 3 and therefore discharges stored high pressure gases from storing chamber 2 into burning chamber 1. When the fuel-mixture ignites and expands, the cam 5 maintain the valve 3 in an open position to enable the expanding gases to recharge into the storing chamber 2 to the peak pressure. The cam 5 then closes the valve 3 to keep an utmost pressure inside the storing chamber 2.

Since the storing chamber 2 keeps very high pressure gases supplied right from the engine power, therefore, this pressure is certainly higher than it was in the maximum compressed state. Therefore, when the engine is in its next utmost compression (during the next compression stroke) the valve 3 opens and the gases stored in chamber 2 flows into the burning chamber 1 to increase the pressure of the compressed fuel-mixture before the next ignition takes place. Right after the ignition the expanded gases again recharge into the storing chamber to the peak pressure and then the valve 3 closes. During the charging pressure to the storing chamber 2, chamber piston 21 is forced outward and spring 22 keeps the resilient energy for stored gas discharge purposes.

I claim:

1. An internal combustion engine comprising:

a housing having a main chamber formed therein, a power member sealingly fitted in the main chamber for cyclical movement between a first position in which the volume of a closed combustion space defined between the power member and a portion of the chamber surface is a maximum and a second position in which the volume of said combustion space is a minimum;

means for supplying air and fuel to the combustion space for combustion therein;

said housing having a storage chamber formed therein and a portal extending between said storage chamber and said combustion space for supplying high pressure gas to said combustion space;

a valve member movable between an open position inside said storage chamber and a closed position, said valve member being engagable with said portal in said closed position for preventing said high pressure gas from entering said combustion space when said power member is moving between said first position and said second position;

a rotatable cam, and a rod extending through said combustion space and having a first end fixed to said valve member and a second end engaging said rotatable cam, for moving said valve member into said open position just prior to ignition of said fuel and air and moving said valve member into said closed position just after said ignition so that the gas pressure in said combustion space is increased just prior to said ignition and high pressure ignited gas may flow into said storage chamber for temporary storage therein just after said ignition; and a resilient spring mounted auxiliary piston formed in said storage chamber for storing energy when said ignited gases are stored in said storage chamber.

* * * * *